US008303207B2

(12) United States Patent
Thacker

(10) Patent No.: US 8,303,207 B2
(45) Date of Patent: Nov. 6, 2012

(54) HYBRID SCAFFOLD SYSTEM

(75) Inventor: Steve Howard Thacker, McKinney, TX (US)

(73) Assignee: Saferlte Platforms Inc, Vista, CA (US)

( * ) Notice: Subject to any disclaimer, the term of this patent is extended or adjusted under 35 U.S.C. 154(b) by 73 days.

(21) Appl. No.: 13/065,562

(22) Filed: Mar. 24, 2011

(65) Prior Publication Data

US 2011/0262215 A1 Oct. 27, 2011

Related U.S. Application Data

(60) Provisional application No. 61/337,156, filed on Jan. 26, 2010, provisional application No. 61/343,087, filed on Apr. 23, 2010.

(51) Int. Cl.
*E04G 7/00* (2006.01)

(52) U.S. Cl. ..... 403/49; 182/186.8

(58) Field of Classification Search ..... 403/49, 403/319, 355, 161; 182/186.7, 186.8
See application file for complete search history.

(56) References Cited

U.S. PATENT DOCUMENTS 4,044,523 A * 8/1977 Layher ..... 52/638
4,587,786 A * 5/1986 Woods ..... 52/638
5,961,240 A * 10/1999 Bobrovniczky ..... 403/49

* cited by examiner

*Primary Examiner* — Michael P Ferguson
*Assistant Examiner* — Daniel Wiley

(57) ABSTRACT

A swing head assembly with a swing head and pin affixed to a first horizontal member. A vertical member with a rosette positioned in coaxial alignment therewith. The rosette has radially arranged cut-outs for receiving the swing head assembly. The swing head assembly is rotatably coupled to the rosette. A second horizontal member has a horizontal member head at an end thereof. The rosette is also able to also receive mating elements of the horizontal member head, the second horizontal member having therein an internal wedge assembly with a wedge portion that extends and retracts from the horizontal member head to lock and unlock the horizontal member head to the rosette. The invention further includes a horizontal member having a swing head assembly at one end and an internal wedge assembly at the second end thereof.

3 Claims, 8 Drawing Sheets

HYBRID SCAFFOLD SYSTEM

CROSS REFERENCE TO RELATED APPLICATIONS

This application claims the benefit of U.S. Provisional Application No. 61/337,156 filed on Jan. 26, 2010, entitled "GRIDLOCK SCAFFOLD APPARATUS AND METHOD" and U.S. Provisional Application No. 61/343,087 filed on Apr. 23, 2010, entitled "HYBRID SCAFFOLD SYSTEM". The present application is related to co-pending application U.S. patent application Ser. No. 12/930,921 filed Jan. 20 2011, entitled "SCAFFOLD SYSTEM AND METHOD."

FIELD OF THE INVENTION

This invention relates to modular scaffolding systems that are erected as impermanent structures to support platforms. Scaffolding is used, inter alia, in the industrial, commercial, petro-chemical, power source, general industry and residential construction markets.

BACKGROUND

Tube and coupler scaffolds are so-named because they are built from tubing connected by coupling devices. Due to their strength, they are frequently used where heavy loads need to be carried, or where multiple platforms must reach several stories high. Components of scaffolds include vertical standards having coupling rings or rosettes, horizontal components such as ledgers and guardrails coupled to the coupling rings or rosettes, footings, decks/platforms and diagonal braces. Their versatility, which enables them to be assembled in multiple directions in a variety of settings, also makes them difficult to build correctly.

FIG. 1 is an illustration of a vertical standard 100. Vertical standards are typically cylindrical tubes 101 comprised of hot-dip galvanized steel or aluminum. A collar with an expanded or reduced diameter or a spigot at either or both ends of the vertical standard facilitates the joining of vertical standards from end to end. Rosettes 102 are positioned and then welded or otherwise attached along the tubes providing connections for horizontal members and diagonal braces. The vertical standard 100 can have from one to 8 or more rosettes placed along the tubing using a predetermined spacing between rosettes, for example, about every 20 inches.

A conventional rosette 200, as seen in FIG. 2, has a central aperture 203 to receive the vertical tubing of the vertical standard, four small openings 201A-D to facilitate right-angled connections of conventional ledgers and four larger openings 202 A-D to facilitate connections at any angles of conventional ledgers. A conventional ledger has a head 204 affixed thereto with a vertical slot and horizontal slot arranged therein. Said head 204 is positioned with respect to the rosette 200 such that the horizontal slot of the head 204 is positioned over and under the rosette 200 and the vertical slot of the head is aligned with an aperture of the rosette 200. A loose wedge 205 is then hammered into the vertical slot (or gap) to couple the ledger via the head 204 to the vertical standard via the rosette 200 using, inter alia, frictional force. The conventional rosette is not configured to accept both a swing arm and ledger.

Disadvantageously, until the wedge 205 is installed there is significant play between the rosette 200 and head of a horizontal member giving rise to safety concerns. Furthermore, once installed, wedges often work free when workers traverse the platform. When these wedges work free, the scaffold can become unstable and collapse. Further, even if the scaffold does not collapse, steel wedges, which as seen in the Figure are not integrated into the head or the ledger, can fall from the scaffold injuring workers below.

What is desired is a hybrid scaffold system that overcomes the disadvantages of the conventional scaffold system.

SUMMARY

The invention comprises a hybrid scaffold system that overcomes the safety and flexibility issues inherent in conventional scaffold systems. The ring, collar, rosette or component with similar functionality, is referred to as a rosette with respect to the invention; the vertical standard or component with similar functionality, is referred to as a vertical member with respect to the invention and the ledger, guardrail or component with similar functionality is referred to as a horizontal member. The use of the foregoing terms is not to be interpreted as limiting the scope of the invention.

More specifically, the invention comprises a swing head assembly comprising a swing head and pin, the swing head assembly being coupled to the first end of a first horizontal member. Another aspect of the invention is a swing head assembly at the first end and second end of the first horizontal member. The invention further includes a vertical member made of vertical tubing, including at least one rosette positioned thereon in coaxial alignment with the vertical tubing, the rosette having radially arranged cut-outs or apertures for receiving at least one swing head assembly. The swing head assembly is rotatably coupled to the rosette at a revolution joint.

The invention further comprises the above described first horizontal member having integrated therein at least one swing head assembly at a first end thereof, in combination with a second horizontal member having an internal wedge assembly therein. The radially arranged cut-outs or apertures of a rosette are dimensioned to accept the swing head assembly and also the mating elements, or prongs, of a head coupled to a horizontal member having an internal wedge assembly (internal wedge head). The internal wedge assembly has a rod with a wedge portion at a first end thereof, the rod being coupled at a second end thereof to an internal crank/cam assembly. An external handle is coupled to a crank/cam axle of the internal crank/cam assembly. The internal wedge head has a bore through the body thereof, which the wedge portion wholly or partially extends to lock the internal wedge head to the rosette and wholly or partially retracts to unlock the internal wedge head from the rosette.

Further embodiments include a horizontal member with a swing head assembly at each end, alone and in combination with a rosette, and further in combination with a horizontal member with an internal wedge assembly and internal wedge head.

To those skilled in the art to which this invention relates, many changes in construction and widely differing embodiments and applications of the invention will suggest themselves without departing from the scope of the invention as defined herein and in the appended claims. The disclosures and the descriptions herein are purely illustrative and are not intended to be in any sense limiting.

DESCRIPTION OF THE DRAWINGS

A more complete understanding of the invention may be obtained by reference to the following Detailed Description, when taken in conjunction with the accompanying Drawings, wherein.

DETAILED DESCRIPTION

The invention comprises a hybrid scaffold system that overcomes the safety and flexibility issues inherent in conventional scaffold systems. The ring, collar, rosette or component with similar functionality, is referred to as a rosette with respect to the invention; the vertical standard or component with similar functionality, is referred to as a vertical member with respect to the invention and the ledger, guardrail or component with similar functionality is referred to as a horizontal member. The use of the foregoing terms is not to be interpreted as limiting the scope of the invention.

Figure 1:
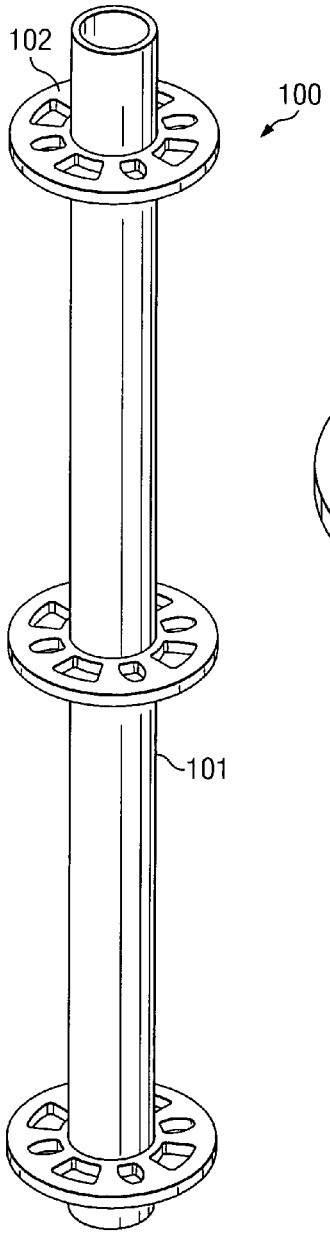
FIG. 1 illustrates a vertical standard.
Figure 2:
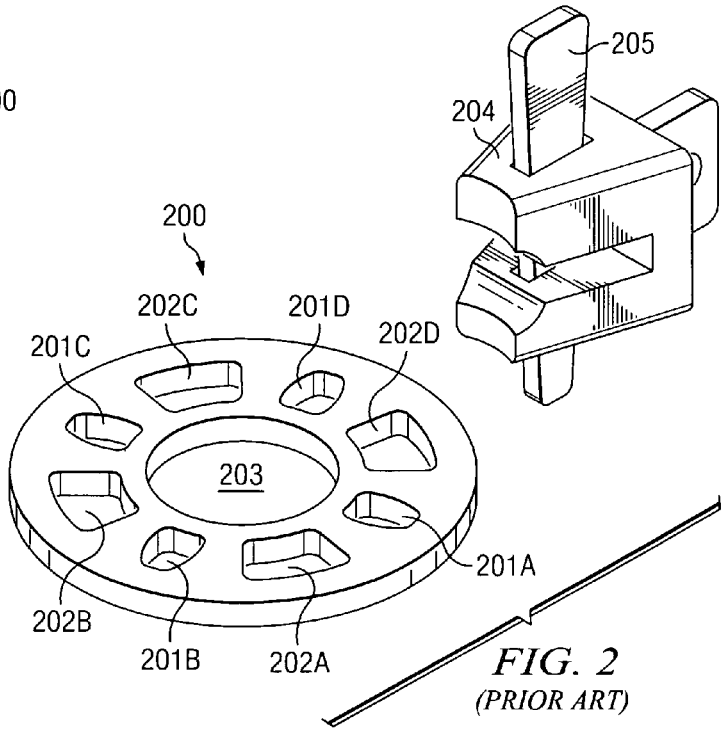
FIG. 2 (PRIOR ART)
FIG. 2 illustrates a rosette and conventional head and wedge.
Figure 3:
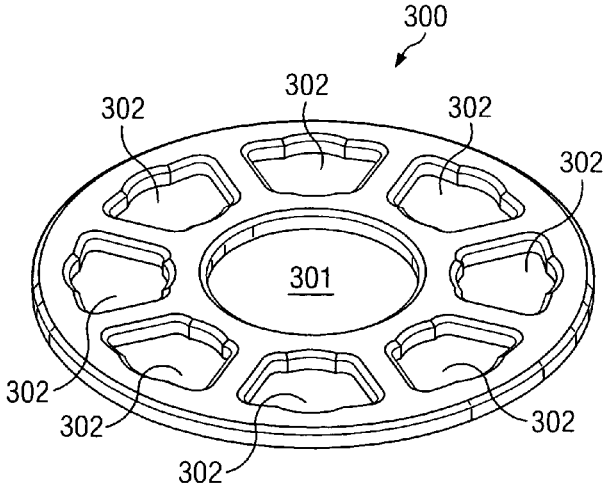
FIG. 3 is one embodiment of a rosette of the invention.

Referring now to FIG. 3, the top view of one embodiment of a rosette 300 of the invention is shown. The embodiment of rosette 300 is circular in shape and has a thickness to it. Rosette 300 has a central aperture 301 or cut-out in a circular shape dimensioned to receive the vertical tubing of the vertical member. Once placed on the vertical tubing, rosette 300 can thus be welded or otherwise attached in a co-axial alignment with the vertical tubing of the vertical member. A plurality of rosettes can thus be positioned and affixed along the length of the vertical tubing. Between the outer circumference of rosette 300 and the outer circumference of the central aperture 301 are a plurality of radially arranged cut-outs 302 for receiving (i) the pin of a swing head assembly and/or (ii) prongs of at least one internal wedge head as further described herein. The grid arrangement of the radially arranged cut-outs 302 allow for the flexible configuration or arrangement of swing arms and/or horizontal members to the vertical member via rosette 300. FIG. 3 illustrates eight (8) radially arranged cut-outs 302, although a different number of radially arranged cut-outs 302 can be arranged on rosette 300. In an embodiment of the invention, the radially arranged cut-outs 302 generally comprise trapezoids with inner and outer edges having circular arcs of concentric circles of different radii. The intersections of the line segments and arcs can be filleted, comprising a concave easing of the interior corners to reduce stress concentration. On a portion of, and further cut out from, the inner and outer edges of such trapezoids are arc shaped notches comprising a portion of a circle centered on the trapezoid. The edges of intersection of each of the upper and lower surfaces of the rosette with the vertical, interior walls of the rosette can be rounded, beveled or chamfered. The radially arranged cut-outs 302 are dimensioned to receive (i) a pin of a swing head assembly and/or (ii) descending, vertical prongs of the internal wedge head.

Figure 4:
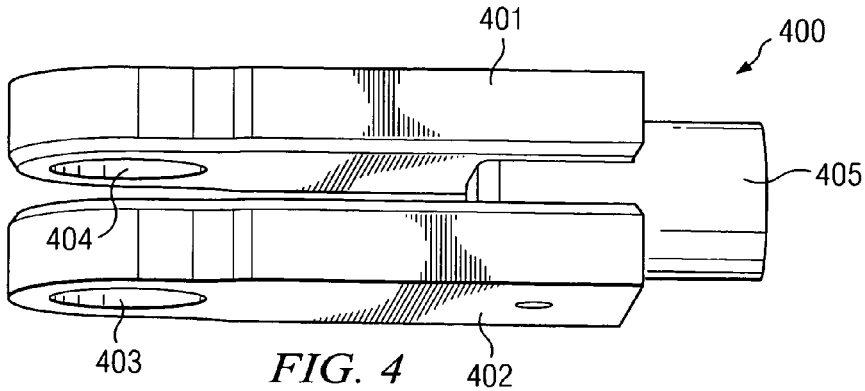
FIG. 4 is one embodiment of a swing head of the invention.

FIG. 4 illustrates a swing head 400 of the invention, said swing head having bifurcated extensions and a connecting member, the bifurcated extensions being an upper extension 401 and a lower extension 402. Each of the upper extension 401 and the lower extension 402 have a flat, top surface, a left side, a flat, bottom surface, a right side, a front side (substantially a space curve or curved wall) and a back side dimensioned to receive, or to be received by a horizontal member, and edges between respective surfaces and sides. Each of the upper extension 401 and lower extension 402 are substantially the same shape and dimension, each being similar to a rectangular prism with the front sides thereof being rounded providing a front side in the form of a curved wall or space curve.

With respect to upper extension 401, the flat planes of the top surface and bottom surface are parallel. The planes of the left side and right side, except where the curvature of the front side commences, are substantially parallel. The planes of the top surface and bottom surface are orthogonal to the left side and right side.

With respect to lower extension 402, the flat planes of the top surface and bottom surface are parallel. The planes of the left side and right side, except where the curvature of the front side commences, are substantially parallel. The planes of the top surface and bottom surface are orthogonal to the left side and right side.

With respect to the orientation of the extensions as described herein, the bottom surface of upper extension 401 is apositioned the bottom surface of lower extension 402.

The upper extension 401 and lower extension 402 are connected with a connecting member 405 sandwiched between their respective bottom surfaces proximate the back sides thereof. The connecting member 405 serves as a further connection to a horizontal member.

A front end of upper extension 401 is proximate the front side of the upper extension 401. Proximate the front end of the upper extension 401 is upper extension bore 404 which passes through the top surface, upper extension body and bottom surface. A front end of lower extension 402 is proximate the front side of the lower extension 402. Proximate the front end of the lower extension 402 is lower extension bore 403 which passes through the top surface, lower extension body and bottom surface.

Figure 5:
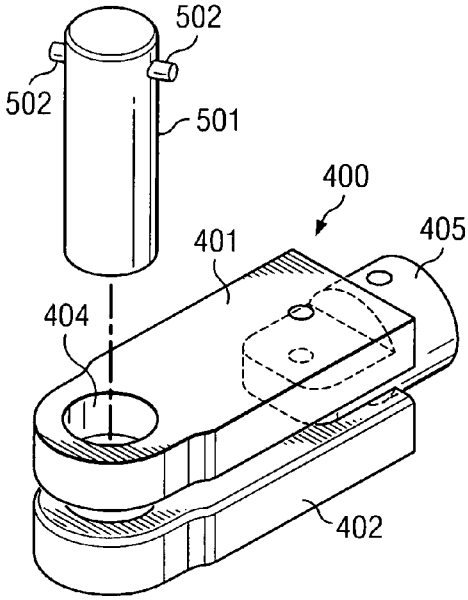
FIG. 5 is a first view of one embodiment of a swing head assembly of the invention.

FIG. 5 is a first view of one embodiment of a swing head assembly of the invention showing the swing head 400 comprised of upper extension 401, lower extension 402 and upper extension bore 404. Also shown in FIG. 5 is pin 501 which is dimensioned to fit within upper extension bore 404, then one of the radially arranged cut-outs 302 of rosette 300 and then lower extension bore 403. Pin 501 further has a pin bore positioned orthogonal to the central axis through the cylindrically shaped pin 501, through which a pin stop 502 comprising a dowel, pin, clevis or component with similar functionality is inserted, the ends of which, when viewed from the top thereof, extend beyond the circumference of pin 501 and serve to retain pin 501 in the upper extension bore 404, radially arranged cut-out 302 of rosette 300 and lower extension bore 403. Alternatively, an end cap or other stopping means can be affixed to an end of pin 501 to retain pin 501 in the swing head. When pin 501 is installed as described, it provides a rotation joint between the rosette and horizontal member allowing swing head (and hence, a horizontal member coupled thereto) to swing, swivel or rotate in the plane of the surface of rosette 300, which plane of rotation is orthogonal to the vertical member to which the rosette is affixed.

Figure 6:
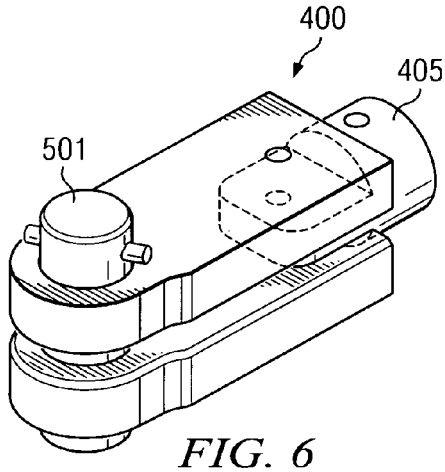
FIG. 6 is a second view of one embodiment of a swing head assembly of the invention.
Figure 7:
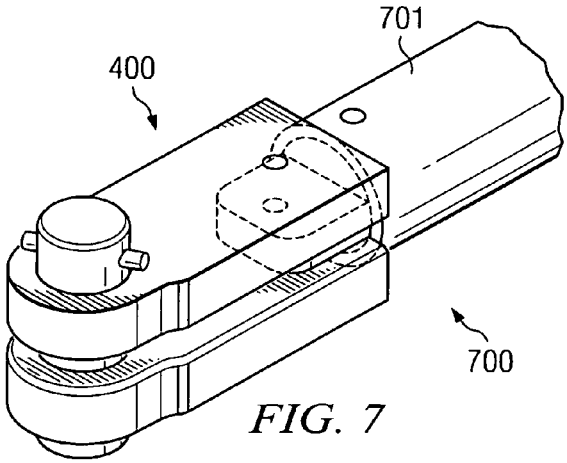
FIG. 7 is a view of one embodiment of a swing arm (swing head assembly coupled to a horizontal member, without the pin) of the invention.

FIG. 6 is a side view of one embodiment of a swing head assembly of the invention showing swing head 400 and pin 501 and connecting member 405. FIG. 7 is a view of one embodiment of a swing arm 700, comprising swing head 400 coupled to horizontal member 701. As seen therein, connecting member 405 is dimensioned to fit within the end of the tubing of an end of horizontal member 701.

Figure 8:
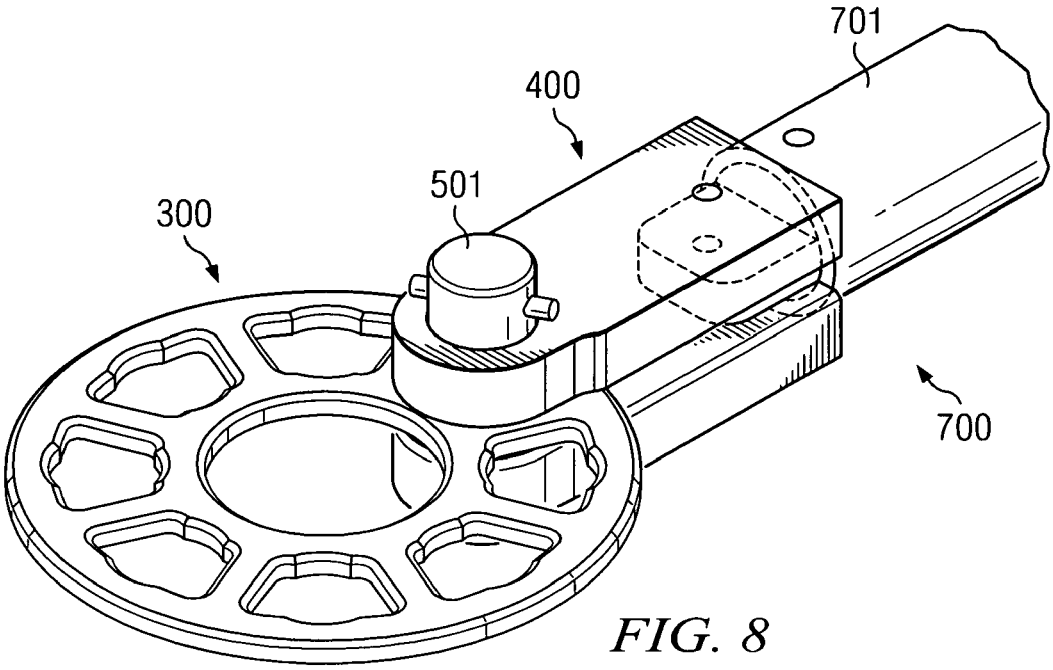
FIG. 8 is a perspective view of the swing arm (swing head assembly on a horizontal member) coupled in a first position to a rosette.
Figure 9:
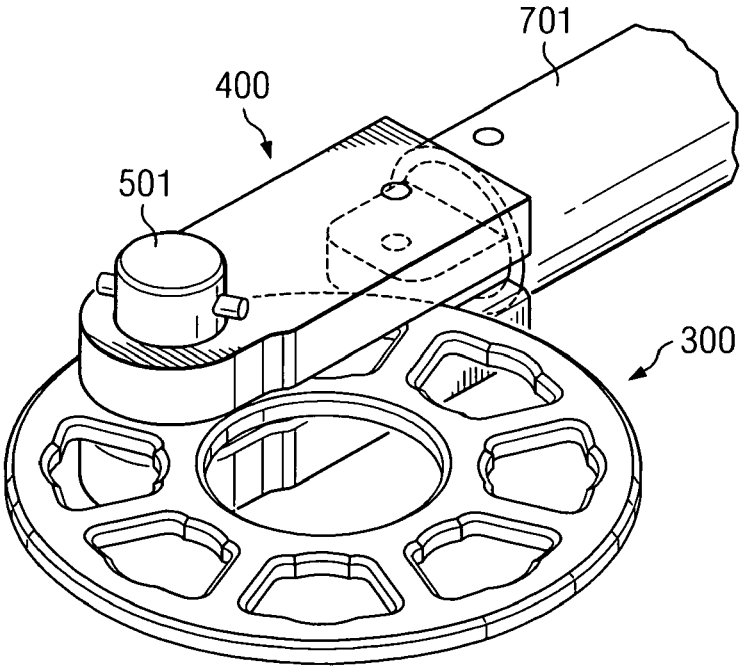
FIG. 9 is a perspective view of the swing arm coupled in a second position to a rosette.

FIG. 8 is a perspective view of the swing arm 700 with the attached swing head assembly which further comprises swing head 400 and pin 501 affixed to horizontal member 701 coupled in a first position to a rosette. FIG. 9 is a perspective view of swing arm 700 with the attached swing head assembly which further comprises swing head 400 and pin 501 affixed to horizontal member 701 rotated into a second position to a rosette from the position seen in FIG. 8.

Figure 10:
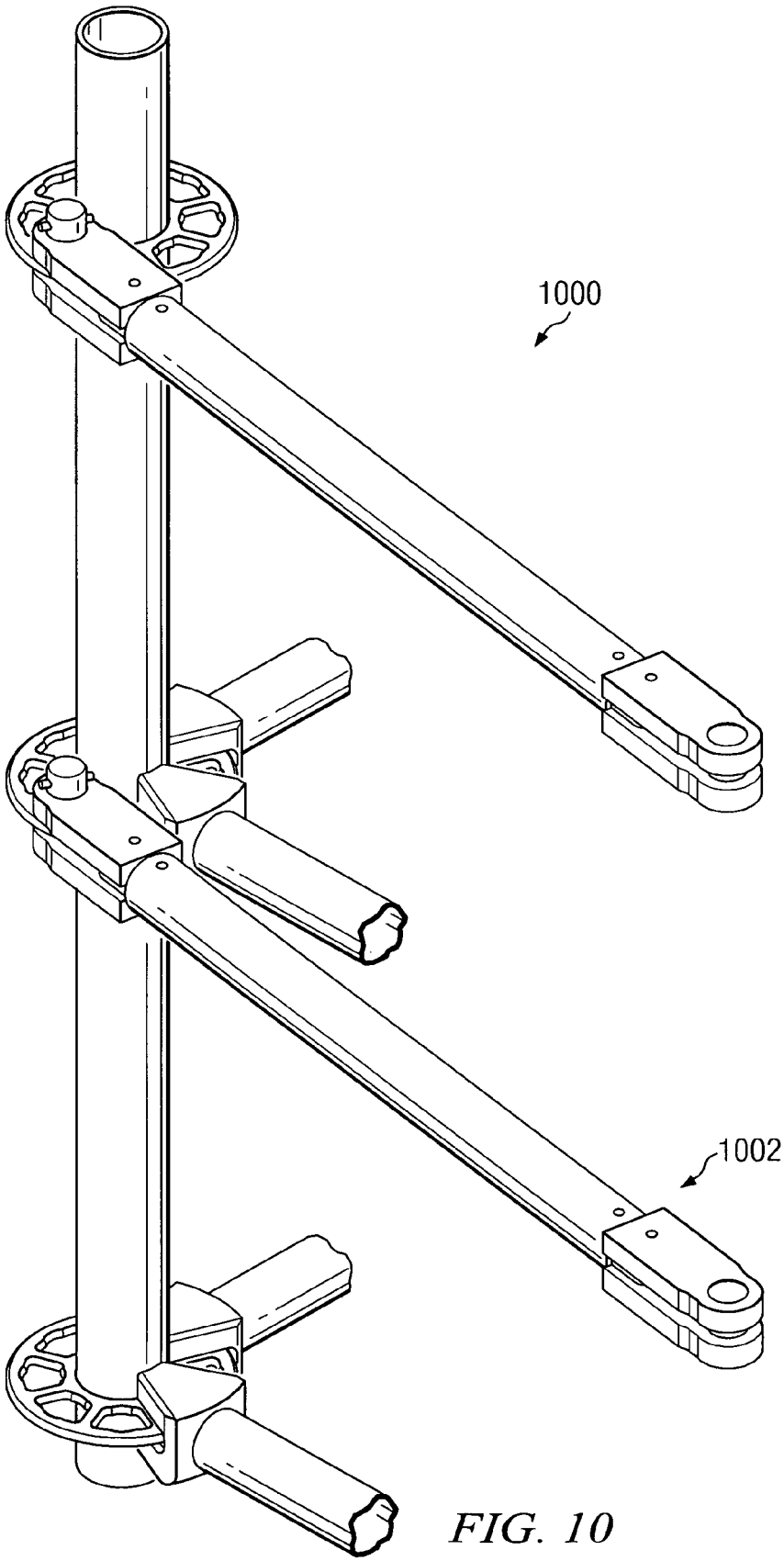
FIG. 10 is a view of two swing arms in a first position coupled to a scaffold.
Figure 11:
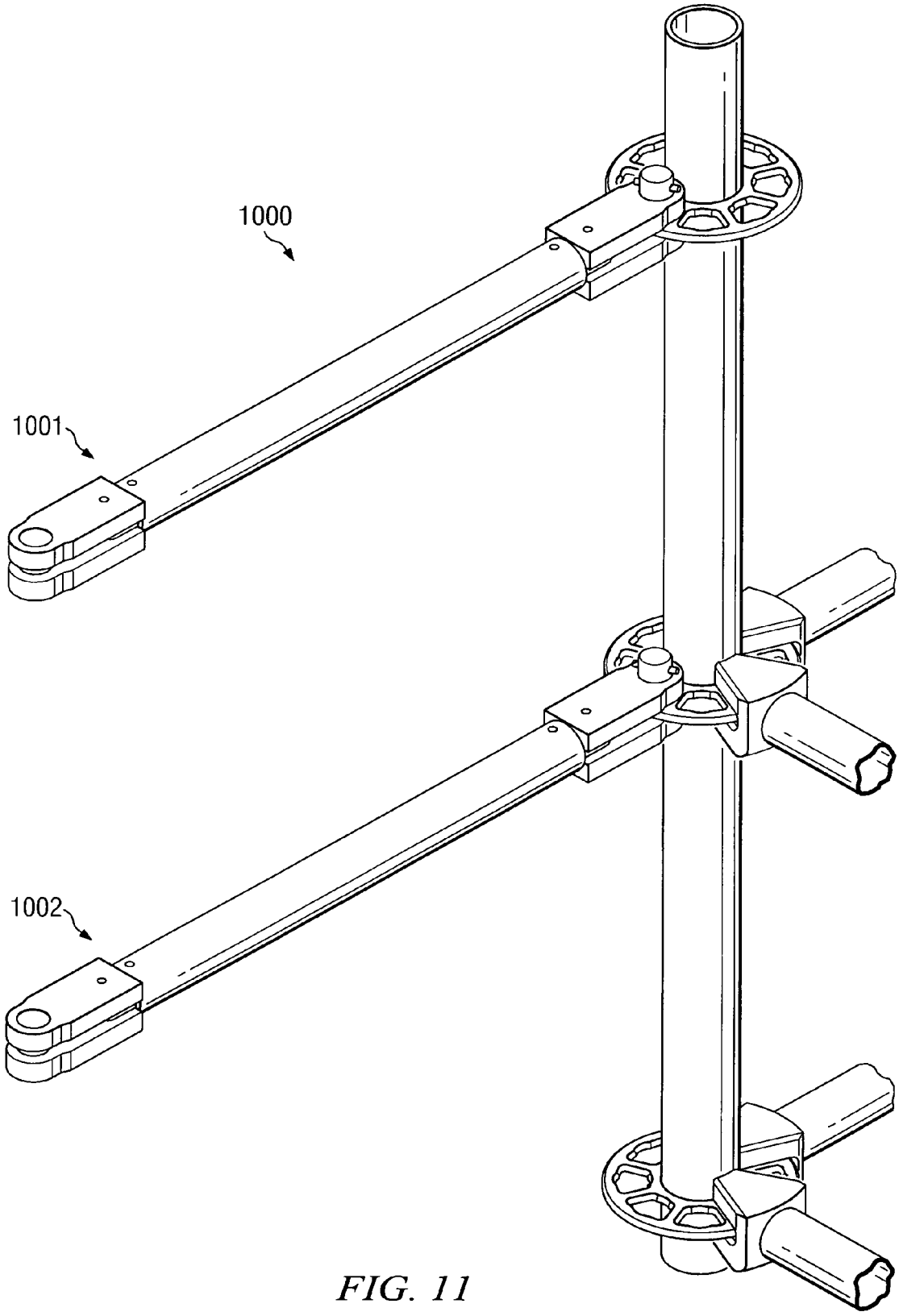
FIG. 11 is a view of two swing arms in a second position coupled to a scaffold.

FIG. 10 is a view of two swing arms 1001, 1002 in a first position coupled to a scaffold 1000. As seen therein, each of the swing arms have, at each respective end thereof, a swing head assembly. FIG. 11 is a view of the two swing arms 1001, 1002 of FIG. 10 in a second position coupled to scaffold 1000.

Figure 12:
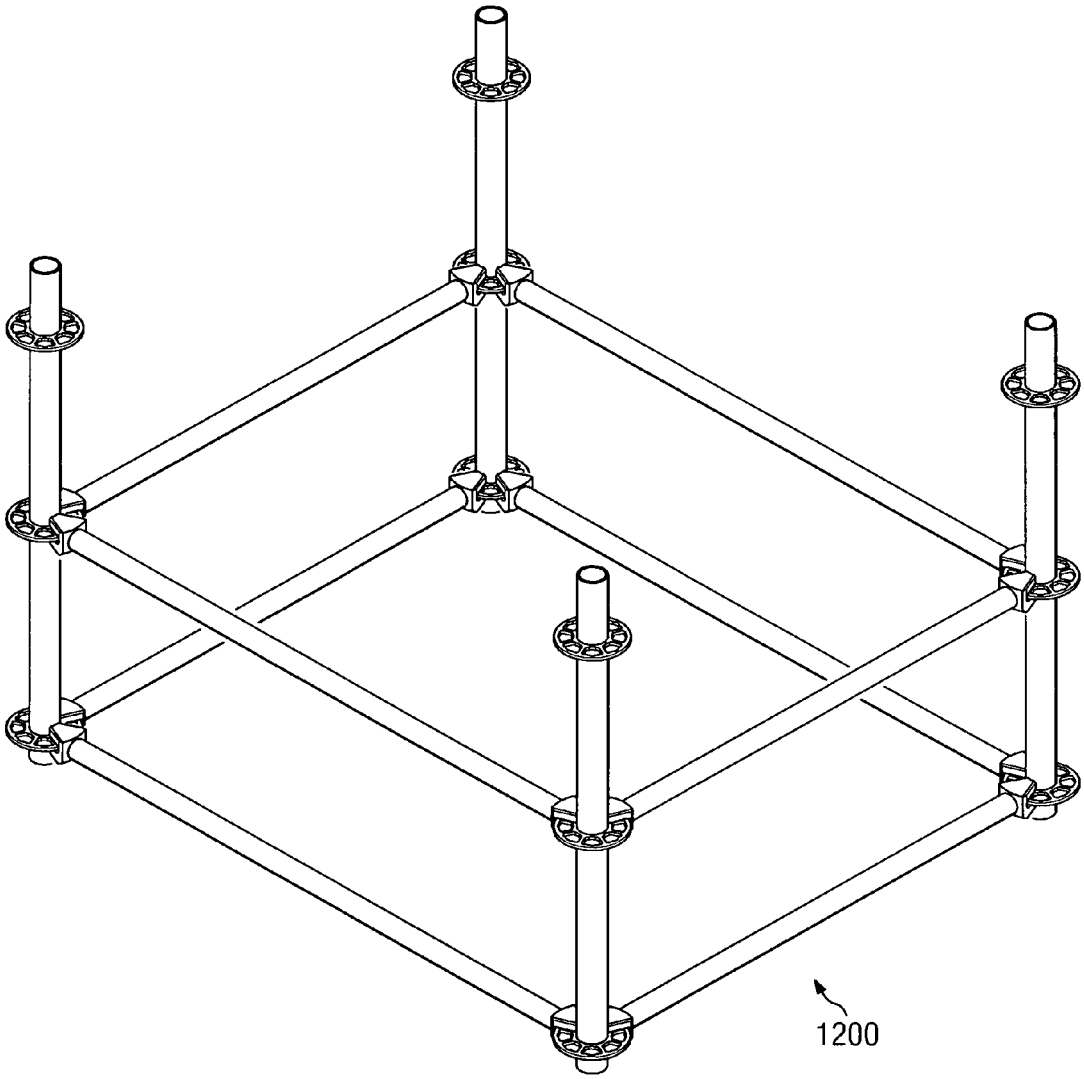
FIG. 12 is a view of a cubic arrangement of vertical members and horizontal members of the invention.
Figure 13:
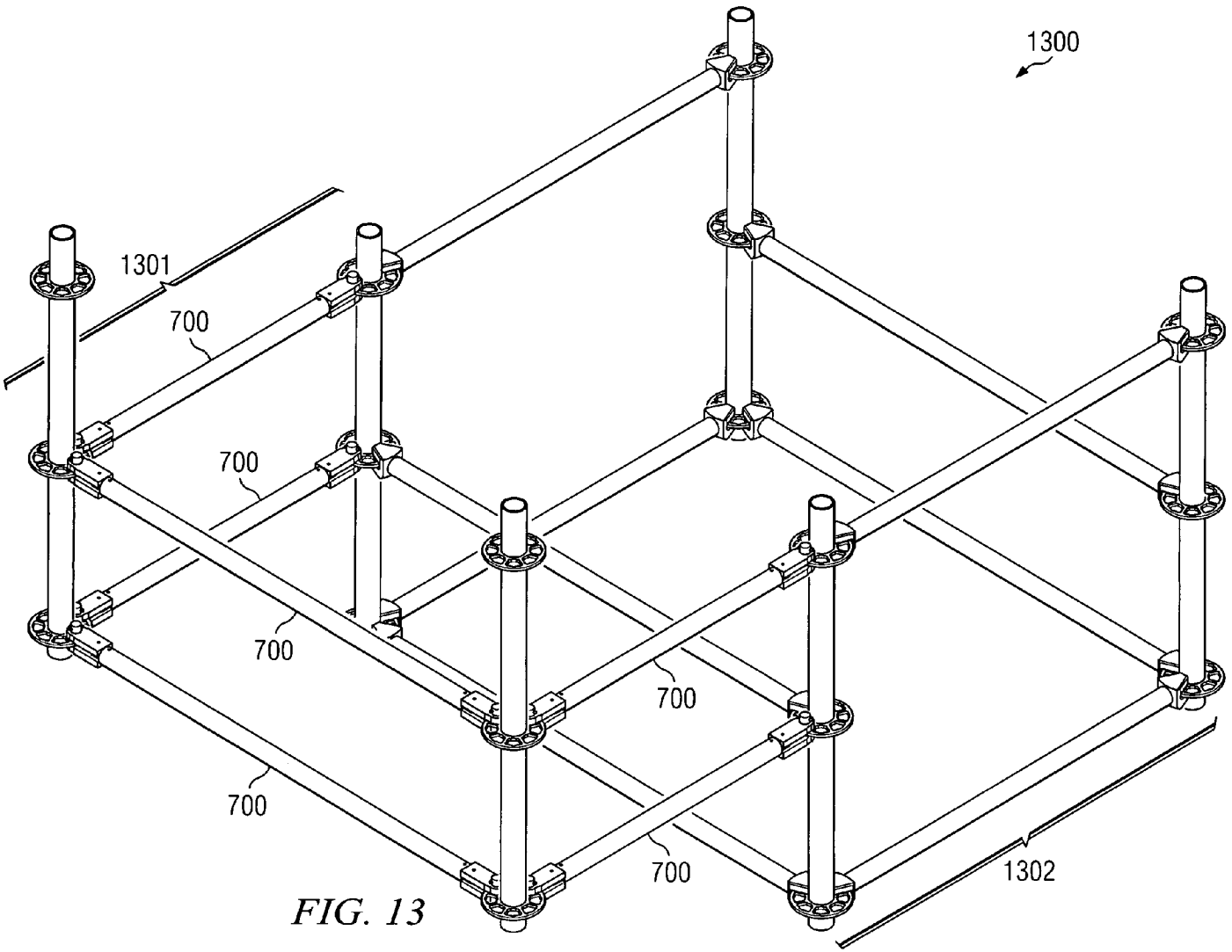
FIG. 13 is a view of a scaffold of the invention wherein a first scaffold portion is suspended from a second scaffold portion, the suspended portion having been erected using swing arms.

FIG. 12 is a view of a scaffold 1200 in a cubic arrangement of vertical members and horizontal members using components of the invention. FIG. 13 is a view of scaffold 1300 having a first scaffold portion 1301 suspended from a second scaffold portion 1302, the suspended portion having been erected using swing arms 700.

Figure 14:
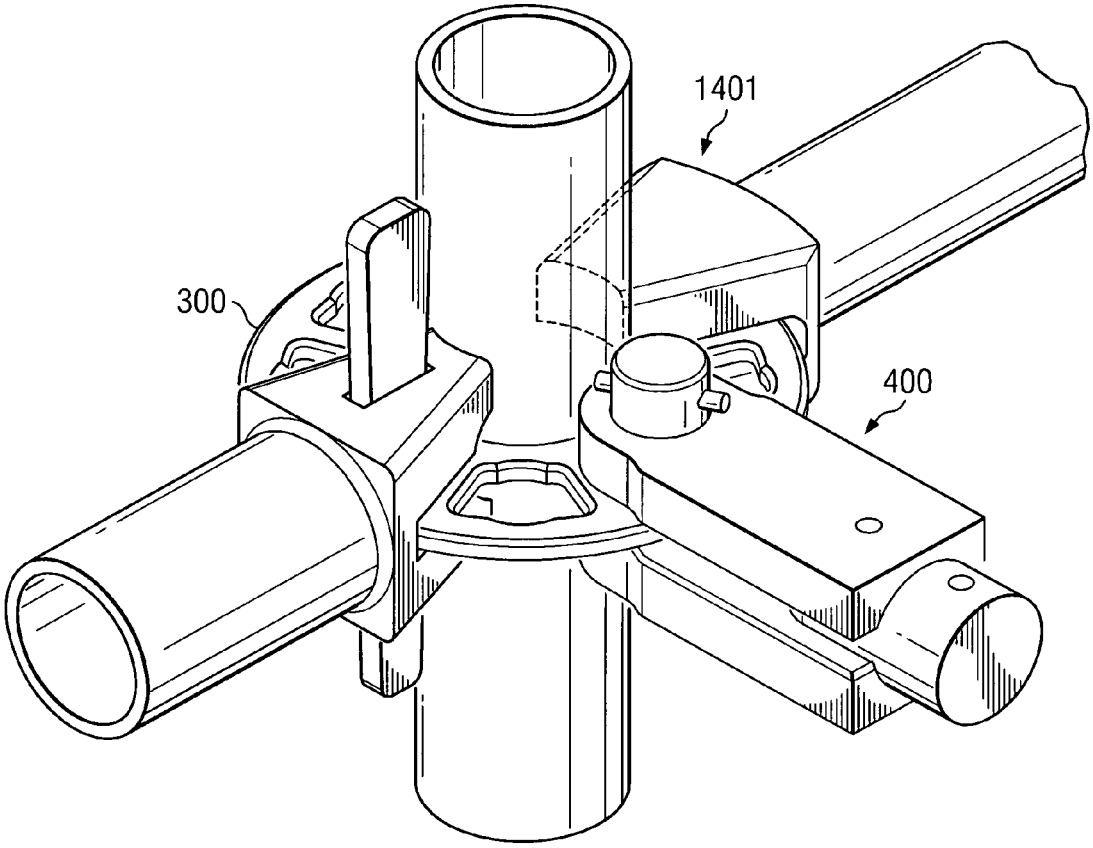
FIG. 14 is a view of a rosette of the invention with a swing head assembly, an internal wedge head and a conventional head and wedge arrangement coupled thereto.

FIG. 14 is a view of the rosette 300 of the invention showing coupled thereto a swing head assembly 400, an internal wedge head 1401 and a conventional head and wedge arrangement. The internal wedge head 1401 is coupled to a horizontal member having an internal wedge assembly. The radially arranged cut-outs or apertures of a rosette 300 are able to also receive mating elements, or prongs, of internal wedge head 1401. The internal wedge assembly has a rod with a wedge portion at a first end thereof, the rod being coupled at a second end thereof to an internal crank/cam assembly in the horizontal member. A handle or crank is coupled to a crank/cam axle of the internal crank/cam assembly, the internal wedge head 1401 having at least one or a plurality of mating elements or prongs dimensioned to fit within certain of the cut-outs or grid of apertures formed in the rosette 300, the internal wedge head 1401 having a bore through which the wedge portion wholly or partially extends out of internal wedge head 1401 to lock internal wedge head 1401 to the rosette 300 and wholly or partially retracts into internal wedge head 1401 to unlock internal wedge head 1401 from the rosette 300.

The invention comprises a swing head assembly comprising a swing head and pin, the swing head assembly being coupled to at least the first end of a first horizontal member. Another aspect of the invention is a swing head assembly at the first end and second end of the first horizontal member. The invention further includes a vertical member made of vertical tubing, including at least one rosette positioned thereon in coaxial alignment with the vertical tubing, the rosette having radially arranged cut-outs or apertures for receiving at least one swing head assembly. The swing head assembly is rotatably coupled to the rosette at a revolution joint.

The invention further comprises the above described first horizontal member having integrated therein at least one swing head assembly at a first end thereof, in combination with a second horizontal member having, preferably, an internal wedge head at least at one end thereof. The radially arranged cut-outs or apertures of a rosette are able to receive mating elements, or prongs, of a horizontal member head, the horizontal member having therein an internal wedge assembly, the internal wedge assembly having a rod with a wedge portion at a first end thereof, the rod being coupled at a second end thereof to an internal crank/cam assembly. A crank or handle is coupled to a crank/cam axle of the internal crank/cam assembly, the horizontal member head having at least one or a plurality of mating elements or prongs dimensioned to fit within certain of the cut-outs or grid of apertures formed in the rosette, the internal wedge head having a bore through which the wedge portion wholly or partially extends out of the horizontal member head to lock the horizontal member head to the rosette and wholly or partially retracts into the horizontal member head to unlock the horizontal member head from the rosette. The horizontal member having an internal wedge assembly is as described in Applicant's co-pending U.S. patent application Ser. No. 12/930,921. As described therein, such horizontal member advantageously allows the user thereof to engage and disengage both wedges coupling a vertical member from a single location.

The invention, as structurally described, functionally allows one to use swing or swing arm horizontal members for cantilevered platforms which can be used, e.g., on off-shore and bridge platforms. The invention facilitates precision angles of horizontal members thus saving time when squaring the base or re-racking the scaffold. The invention facilitates the raising of platforms via swing stage motors or cranes. The invention is configured to enable the erection of suspended platforms in elevated situations.

The invention is seismic qualified due to its novel self-squaring rosette and head combination. The invention is a secondary positive locking design using internal gussets and 360 degree connection rosette designs.

In operation, the invention provides strong, durable load bearing design for light, medium, and heavy duty load capacities. It can be used in flammable and explosive environments due to the nature of its rigid design. Its positive locking design permits it to be assembled in approximately half the time as a conventional scaffold.

The described embodiment of the invention shows a rosette that receives eight horizontal members, but is not limited to such arrangement. The connection of the heads and rosette of the invention is designed to meet 100% tie off requirements and standards. The swing arms of the invention allow the scaffold erector to construct almost any shaped working platform from the air. The swing arms collapse to the main scaffold allowing the scaffold erector to install all the structural components from an existing platform. In the process, the scaffold erector can utilize standard scaffold components such as clamps, tubes, metal planks, horizontal, and vertical scaffold members. After all the structural components are installed, the erector can swing the horizontal components out up to 180 degrees. Hence, in one embodiment, the platform can be cantilevered approximately (10) feet unsupported. Once the erector has the swing arms at a 90 degree position, he can utilize standard scaffold components such as metal planking and tubes and clamps to support and deck of the invention. In this manner, the erector can install an initial smaller platform then "leap-frog" the platform while still suspended. The erector also has the option to build a scaffold from the ground or other elevations then work the structure vertically and upward. A conventional system us unable to provide this flexibility as it must be suspended from structural steel or elevated by swing stage motors. In contrast, using the invention, the erector can build multiple levels from the ground up or suspend from steel if needed or even fly with swing stage motors.

The swing head and connected horizontal member of the invention facilitates the insertion of a lattice bolt/pin at each connection joint. The clevises shape of the swing arm assembly supports the base of the platform thus allowing it to be suspended and elevated via swing stage motors. This is an additional advantage of the invention over a conventional scaffold.

The invention advantageously permits an erector to suspend a platform in an elevated position. By installing the swing arms in their collapsed position it allows the erector to install additional platforms from a safe, stable location.

As noted herein, components of the invention include at least one horizontal member which horizontal member preferably has a swing head at each end thereof, at least one vertical member including at least one rosette coaxially positioned thereon, the rosette having apertures for receiving (i) a pin of the swing head assembly and/or (ii) mating elements or prongs of an internal wedge head coupled to a horizontal member with an internal wedge assembly therein, the internal wedge assembly having a first rod with a wedge portion at a first end thereof, the first rod being coupled at a second end thereof to an internal crank/cam assembly, a crank or handle coupled to a crank axle of the internal crank/cam assembly, the internal wedge assembly further having a second rod with a wedge portion at a first end thereof, the second rod being coupled at a second end thereof to the internal crank/cam assembly. The internal wedge assembly causes the wedge portion to be wholly or partially extendable and retractable into the internal wedge head and/or hollow tube of the horizontal member, wherein, when the mating elements of the horizontal member are received in the radially arranged cut-outs of the rosette, the internal wedge assembly, when actuated, causes the wedge portion to rigidly join the horizontal member to the rosette.

The invention has at least one rosette coaxially attached, via, e.g., a weld, to each vertical member, and a vertical member may have a plurality of evenly or unevenly spaced rosettes coaxially welded along a vertical member. The rosette has a pattern or grid of apertures designed to receive the mating elements, such as prongs at the end of a horizontal member. A head may be located at the end of the horizontal member. The horizontal member is a hollow tube, preferably cylindrical in shape, having a first end and a second end. At the first end and the second end may be fixedly attached, a swing head assembly or wedge head assembly, as more fully described herein.

The embodiments shown and described above are only exemplary. Even though numerous characteristics and advantages of the preferred embodiment of the invention have been set forth in the foregoing description together with details of the invention, the disclosure is illustrative only and changes may be made within the principles of the invention to the full extent indicated by the broad general meaning of the terms used herein. For example, the concepts described herein for coupling horizontal members to vertical members can be adapted to couple bracing members to vertical members or to horizontal members. Coupling includes, but is not limited to attaching, engaging, mounting, clamping, welding, bolting and components used for coupling include bolts and nuts, rivets, clevis, latches, clamps, welds, screw, rivet and the like. Further, a rosette having eight (8) radially arranged cut-outs is described herein for illustrative purposes and a rosette having more or less radially arranged cut-outs is considered to be within the scope of this invention. Also, the invention describes a rosette having a standard diameter of about seven (7) inches, however, any suitable diameter can be used. The rosette can include any suitable cut-out shape that is dimensioned to receive a corresponding pin of the swing head assembly. The vertical member can have any number of coaxially aligned rosettes attached thereto, the vertical spacing of such rosettes being any such distance as is suitable for the intended use.

I claim:

1. A swing joint for use in a scaffold system, said swing joint comprising:

a swing head assembly, said swing head assembly comprising:

a swing head, said swing head comprising opposed upper and lower extensions, each extension being of a generally rectangular prism shape and of substantially the same size as the other extension, each extension comprising a flat outer surface and a flat inner surface opposite the outer surface, and arranged such that the inner surface of the upper extension is parallel to and faces the inner surface of the lower extension; wherein each extension further comprises a front end and a rear end opposite the front end, and a gap is formed between the inner surfaces of each extension proximate the front ends thereof, each of the respective front ends including a substantially curved surface, and wherein the respective rear ends of each extension are connected at their respective inner surfaces to a connecting member, said connecting member being sized to be received by a horizontal member; wherein said upper extension further includes a upper through-bore extending from its outer surface to its inner surface proximate its front end, and said lower extension comprises a lower through-bore extending from its outer surface to its inner surface proximate its front end, said upper through-bore and said lower through-bore having substantially the same inner diameter and being substantially axially aligned with each other; and a cylindrical pin, said pin having an outer diameter corresponding to said upper through-bore and said lower through bore; and a rosette, said rosette comprising an annular disk with a central aperture extending therethrough, said central aperture sized to receive a vertical tubular member, said rosette further comprising a plurality of circumferentially arranged cut-outs extending therethrough, wherein said cut-outs are located radially between said central aperture and an outer circumference of said rosette; wherein said cut-outs are defined by a pair of concentric inner and outer arcuate edges, each pair of said inner and outer arcuate edges being joined together and spaced apart by a pair of radially extending edges, wherein said inner arcuate edges each comprise a first arc-shaped notch proximate a center thereof, said first arc-shaped notches extending inwardly towards said central aperture, and wherein said outer arcuate edges each comprise a second arc-shaped notch proximate a center thereof, said second arc-shaped notches extending outwardly towards said outer circumference of said rosette, such that the first and second arc-shaped notches of each cut-out define a circular aperture, said circular aperture having a diameter corresponding to the inner diameters of the upper and lower through-bores and with the outer diameter of said pin;

wherein, in an assembled state, said rosette is received within said gap between the upper and lower extensions so that the upper and lower through-bores are axially aligned with a respective circular aperture of one of said plurality of cut-outs, and said pin is inserted through said upper and lower-through bores and through said circular aperture.

2. The swing joint of claim 1, wherein said rosette has eight circumferentially arranged cut-outs.

3. The swing joint of claim 1, wherein said pin further includes a pin stop.

* * * * *